US008888188B2

(12) United States Patent
Moffat

(10) Patent No.: US 8,888,188 B2
(45) Date of Patent: Nov. 18, 2014

(54) ADJUSTABLE KNEELING SUPPORT PAD

(71) Applicant: Gary Moffat, Arlington, WA (US)

(72) Inventor: Gary Moffat, Arlington, WA (US)

( * ) Notice: Subject to any disclaimer, the term of this patent is extended or adjusted under 35 U.S.C. 154(b) by 23 days.

(21) Appl. No.: 13/669,392

(22) Filed: Nov. 5, 2012

(65) Prior Publication Data

US 2013/0111643 A1 May 9, 2013

Related U.S. Application Data

(60) Provisional application No. 61/555,568, filed on Nov. 4, 2011.

(51) Int. Cl.

| | |
|---|---|
| ***A47C 7/50*** | (2006.01) |
| ***A47C 16/02*** | (2006.01) |
| ***A41D 13/06*** | (2006.01) |
| ***A47C 3/16*** | (2006.01) |

(52) U.S. Cl.

CPC ..... *A41D 13/065* (2013.01); *A47C 3/16* (2013.01); *A47C 16/02* (2013.01)

USPC ..... 297/423.11; 297/423.41

(58) Field of Classification Search

CPC ..... A47C 16/02; A47C 3/16

USPC ..... 297/423.41, 423.44, 411.1, 411.36, 297/423.11, 4; 135/65; 482/142, 145; 248/118.3, 411, 410, 412

See application file for complete search history.

(56) References Cited

U.S. PATENT DOCUMENTS

| | | | | |
|---|---|---|---|---|
| 669,389 | A * | 3/1901 | Gundry | 279/43.5 |
| 830,103 | A | 9/1906 | Rundell | |
| D114,303 | S | 4/1939 | Sullivan et al. | |
| 2,240,228 | A * | 4/1941 | Schall | 482/140 |
| 2,237,909 | A | 8/1941 | Lund | |
| 2,318,416 | A | 5/1943 | Peirce | |
| 2,829,705 | A | 4/1958 | Godshalk et al. | |
| 4,222,559 | A | 9/1980 | Hammer | |
| 4,565,409 | A * | 1/1986 | Hollonbeck et al. | 297/411.1 |
| D287,074 | S | 12/1986 | Ritchie | |
| 4,998,298 | A | 3/1991 | Mitchell | |
| D317,833 | S | 7/1991 | Miller et al. | |
| 5,316,528 | A * | 5/1994 | Ziparo | 482/52 |
| 6,883,177 | B1 | 4/2005 | Ouellette et al. | |
| D592,411 | S | 5/2009 | Moffat | |
| 2008/0313815 | A1 * | 12/2008 | Guesquiere | 5/690 |

* cited by examiner

*Primary Examiner* — Milton Nelson, Jr.

(74) *Attorney, Agent, or Firm* — Dean A. Craine

(57) ABSTRACT

A portable kneeling support pad used protect and reduce stress on the user's knees when kneeling or standing up from a kneeling position. The support pad includes a flat rectangular base with a chemical resistant, resilient top surface and a flat bottom surface. Attached near one end of the base is a perpendicularly aligned support pole with a handle attached to its distal end. The handle includes a horizontal gripping member that a user may grip when kneeling or standing to an upright position. The base includes a stub perpendicularly aligned with the top surface that selectively engages the lower end of the support pole. Disposed around the upper end of the stub is an adjustable clamp that enables the support pole to rotate 360 degrees around the stub and to move longitudinally relative to the stub to decrease or increase the height of the handle over the support pad.

9 Claims, 5 Drawing Sheets

ADJUSTABLE KNEELING SUPPORT PAD

This invention is based on and claims the priority filing date of Nov. 4, 2011 of U.S. provisional patent application 61/555,568.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to support pads to protect the knee when kneeling.

2. Description of the Related Art

Occasionally, a driver to must bend and kneel on the ground to inspect or clean the tires or wheels on his or her motor vehicle. When inspecting or cleaning the tires or wheels outdoors, many drivers prefer to place a protective rug or pad on the ground to protect their knees form dirt and water and to provide comfort. For some drivers, kneeling down and standing up can also be troublesome.

Earlier, the inventor attempted to solve these problems by developing a portable kneeling pad that includes a rectangular shaped rigid pad with a fixed support pole perpendicularly aligned at one end. Attached to the distal end of the support pole is a horizontal aligned hand grip, (see U.S. Design Pat. No. D592,411, issued on May 19, 2009). Although not relevant to the overall ornamental shape, the support pole was securely attached to one end of the pad and fixed in length creating an L-shaped structure that is difficult to store in the jack storage area in the trunk of a motor vehicle or on the shelf in a cabinet with other cleaning products.

Patients with back problems are told to rest horizontally on the floor. When they have to stand up, they are instructed to slowly roll to one side, tuck one knee under and then slowly rise and support themselves with their arms against a rigid support object or surface. When lying in the middle of a room, a rigid support object or surface to support the patient when trying to stand up is not always available. A flat kneeling pad with a rigid support pole that includes a horizontal grip handle at one end that a patient with back problems may use to help them move from a prone to a standing position would be highly desirable.

SUMMARY OF THE INVENTION

It is an object of the present invention to provide a portable kneeling support pad used to relieve discomfort on a person's knee when kneeling. The support pad includes a flat rectangular base with a resilient top surface. Attached near one end of the base is a detachable, perpendicularly aligned, support pole with a horizontally aligned grip handle attached to the pole's distal end. The base includes a support pole bore with a coaxially aligned stub partially inserted therein that extends upward and perpendicular to the base's stop surface. In one embodiment, the stub is designed to slide over the proximal end of the support pole thereby holding the support pole in a perpendicular alignment over the base. Attached to the distal end of the support post is a handle with a horizontal gripping member that enables the user to press against when standing to an upright position.

Disposed around the upper end of the stub is an adjustable clamp that when loosened, allows the user to selectively rotated the support pole 360 degrees around the stub and to selectively lower and raise the support pole into the stub to decrease or increase the height of the hand grip over the base to a desired amount. When the support pole is removed from the stub, the support base may be longitudinally aligned on the base and stacked against the top surface and an strap may be wrapped around the base and the support pole to hold them together.

In one embodiment, the pad's resilient top surface is made of chemical resistant material, such as nitrile rubber.

DESCRIPTION OF THE PREFERRED EMBODIMENT(S)

Figure 1:
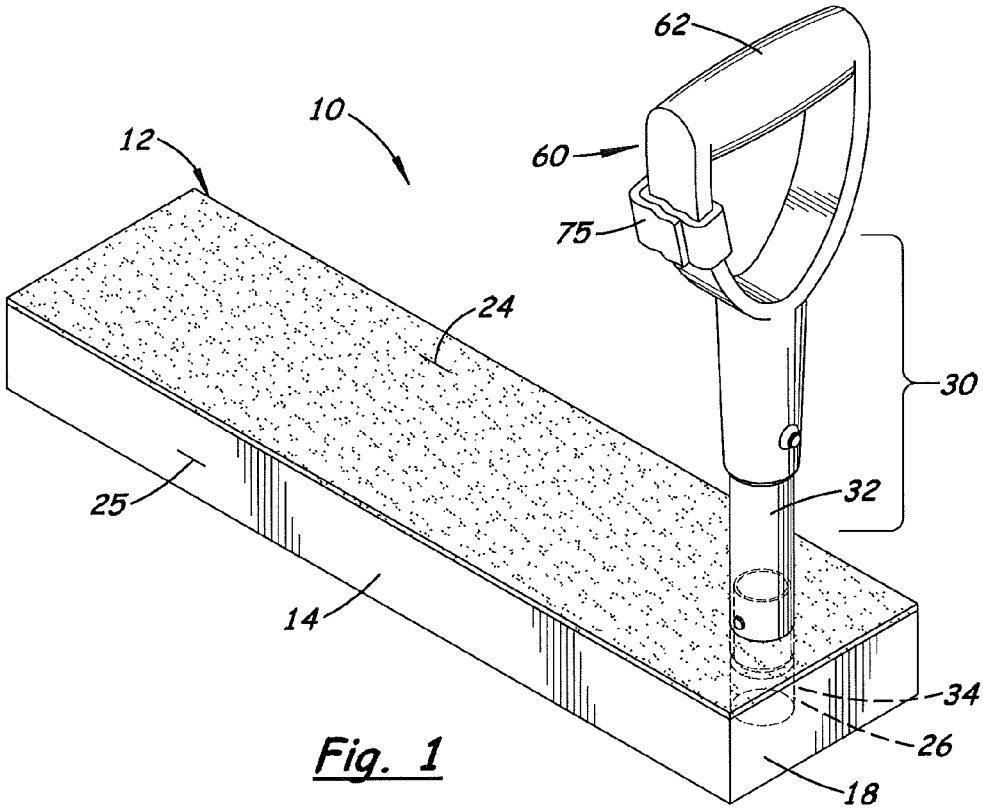
FIG. 1 is a perspective view of the first embodiment of the kneeling support pad with a detachable handle.

Referring to the accompanying FIGS. 1-8, there is shown several embodiments of a portable kneeling support pad (denoted by 10 and 10') each used to relieve discomfort on a person's knee when kneeling and to assist them when standing up. Both embodiments include a removable, support pole 30 with a rigid grip handle 60. In one embodiment, the support pole 30 has a fixed length and fixed orientation. In a second embodiment, the support pole 30 may be selectively adjusted in length and rotated 360 degrees.

The support pad 10 includes a flat rectangular base 12 with two parallel side surfaces 14, 16, two parallel end surfaces 18, 20, a flat bottom surface 22 and a resilient top layer 24. Attached near one end of the base 12 is a perpendicularly aligned support pole 30 with a horizontally aligned grip handle 60 attached to the distal end of the support pole 30.

The support pole 30 is removably attached to the base 12 thereby enabling the support pad 10 to be disassembled and stored in a compact, space saving configuration. The support pole 30 includes an upper tube section 32 that is longitudinally aligned and mounted on a perpendicularly aligned stub 34 that extends upward from a bore 26 formed in the base 12. The stub 34 is hollow and longitudinally aligned and extends upward from the bore 26. A suitable adhesive 28 is used to securely attach the lower end of the stub 34 to the bore 26.

Figure 3:
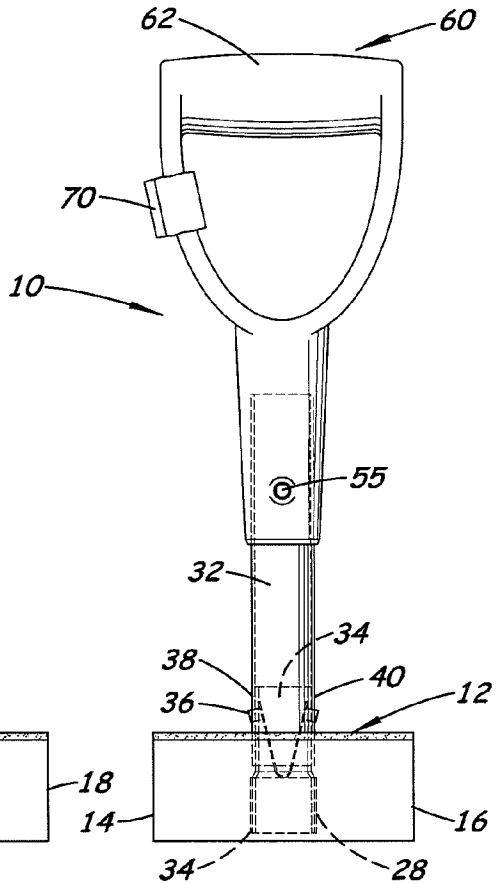
FIG. 3 is a front elevational view of the support pad shown in FIGS. 1 and 2.
Figure 2:
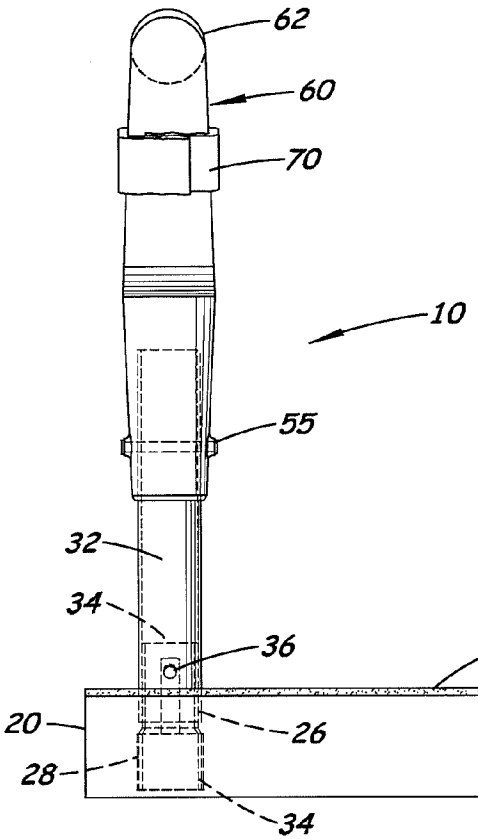
FIG. 2 is a side elevational view of the support pad shown in FIG. 1.

As shown more clearly in FIGS. 2 and 3, a biasing peg clamp 36 is attached to the top section of the stub 34. The peg clamp 36 extends outward from the sides of the stub 34 and engage two bores 38, 40 formed on the lower portion of the support pole 30. The distal end of the support pole 30 extends upward and into the lower sleeve member formed on the grip handle 60. Extending transversely through the support pole near the distal end is a pin 55 that extends laterally and engages holes formed on the grip handle 60 to hold the grip handle 60 in place on the support pole 30.

Figure 4:
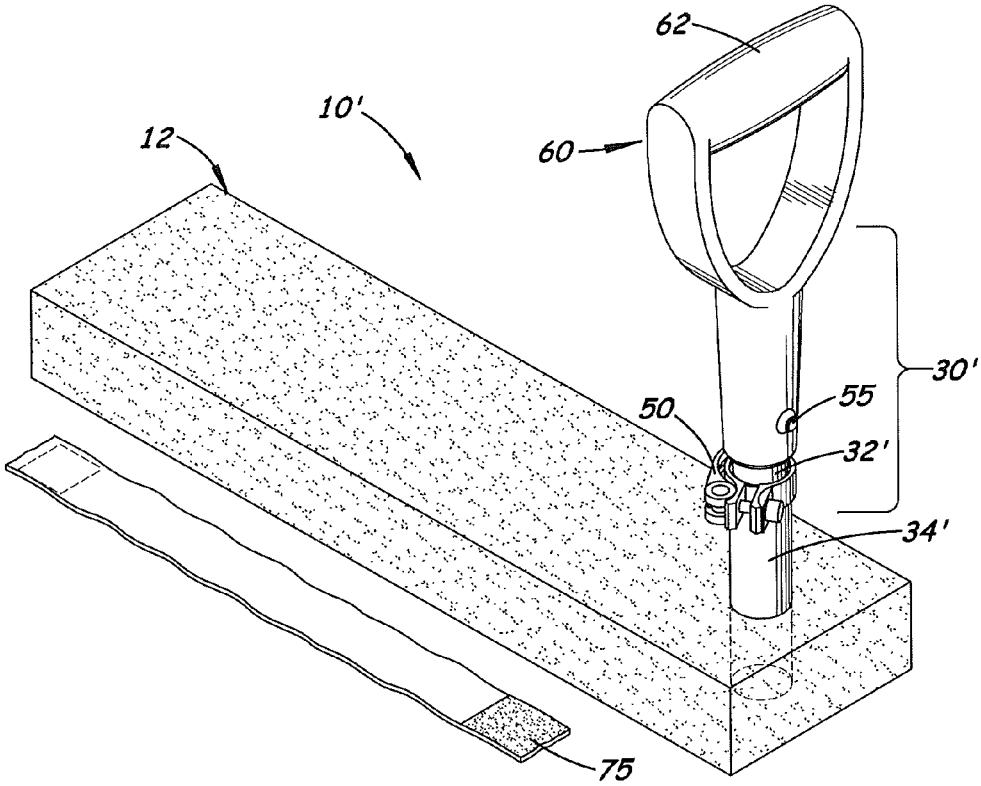
FIG. 4 is a perspective view of a second embodiment of the kneeling support pad with a rotation and length adjustable handle.
Figure 6:
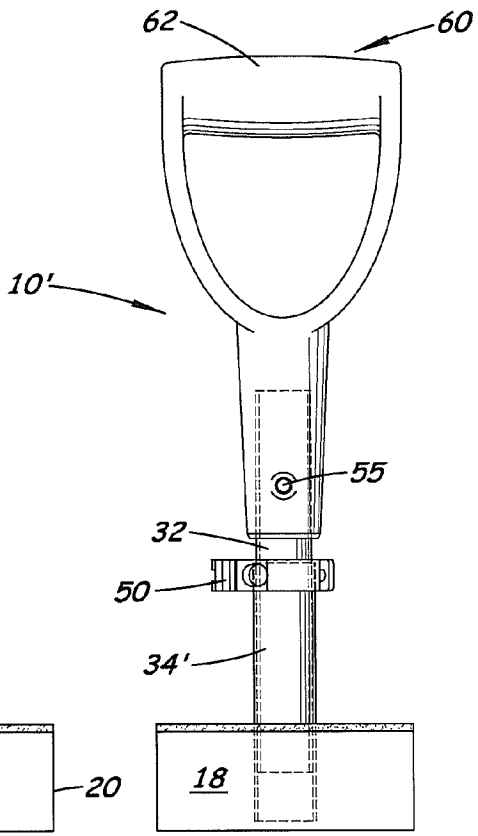
FIG. 6 is a front elevational view of the support pad shown in FIGS. 4 and 5.
Figure 5:
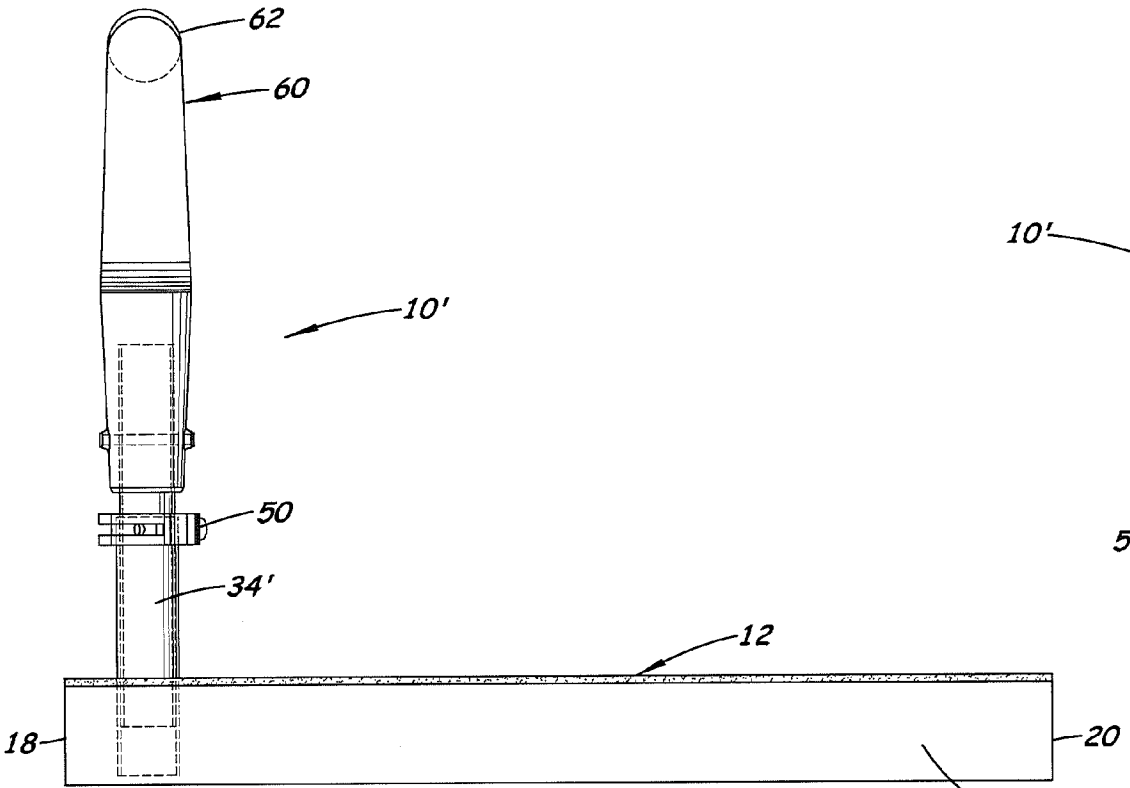
FIG. 5 is a side elevational view of the support pad shown in FIG. 4.

In a second embodiment, of the support pad, indicated by the reference number 10' is shown in FIGS. 4-6, includes a support pole 30' that is both adjustable in length and rotates freely 360 degrees over the stub 34. The support post 30' is slightly smaller in diameter than the stub 34 thereby enabling it to slide up and down inside the stub 34' and to rotate freely 360 degrees.

Figure 7:
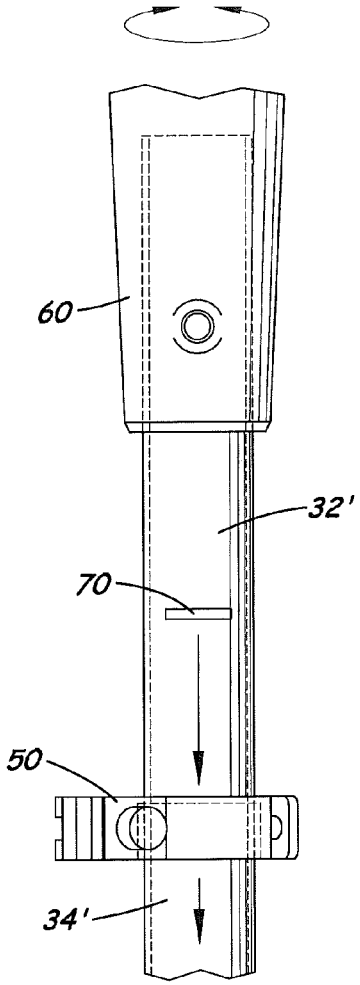
FIG. 7 is front elevational view of the upper pole section being longitudinally aligned and attached to the lower pole section and a clamp located near the upper end of the lower pole section that enables the upper pole section to moved longitudinally and rotate inside the lower pole section and thereby enabling the user to adjust the support pole's overall length and adjust the orientation of the grip handle on the support pole.
Figure 8:
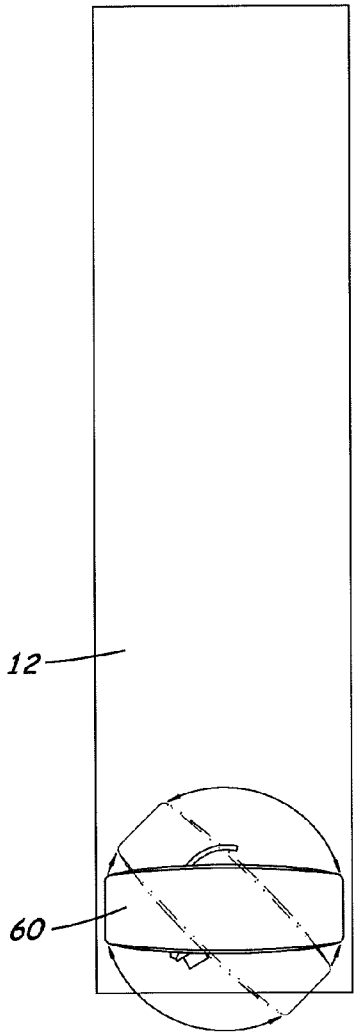
FIG. 8 is a top plan view of the kneeling support pad shown in FIGS. 4-7 showing the grip handle being rotated 360 degrees around the longitudinal axis of the support pole.

Attached to the stub 34' is an adjustable clamp 50 that when activated, forces the stub 34' inward causes the inside surface to press against the outside surface of the upper tube section 32' of the support pole 30' thereby fixing the support pole 30' at a fixed location with respect to the stub 34'. As shown in FIG. 7, an optional depth line 70 may be imprinted on the support pole 30' that informs the user the maximum length the support pole 30' should be extended from the stub 34'. Like the first embodiment, extending transversely through the distal end of the support post 30' is a pin 55 that holds the grip handle 60 in place.

The grip handle 60 includes a horizontal support surface 62 designed to act as a gripping structure and as a support structure that will support the user when standing up. As stated above as and shown in FIG. 8, the grip handle 60 may be rotated 360 degrees around the longitudinal axis of the support pole 30'

In both embodiments, the base 12 is made resilient material. In the preferred embodiment, the resilient material is made of nitrile rubber which resists caused by petroleum based liquids commonly found around a motor vehicle. FIGS. 1 and 3 shows a top layer 24 made of nitrile rubber adhesively attached to a lower plastic layer 25. FIG. 40 show the base 12 made exclusively of nitrile rubber.

The base 12 is approximately 1 to 1½ inches thick and measures 12 to 18 inches in length and 5 to 8 inches in width. The stub 34 and support poles 30 and 30' are both made of aluminum tubing approximately 1 to 1⅛ inches in diameter. The above description describe and the Figs. show the support pole 30 and 30' sliding into the stub 34 and with the clamp attached to the stub 34. It should be understood, however, that alternatively the stub 34 and support pole 30 could be modified so that stub 34 slides into the support pole 30.

The pad 10 is distributed with an adjustable strap 75. The strap 75 may be wrapped and stored on the griping handle 60 or unfolded as shown in FIG. 4. When the support pole 30 or 30' is removed from the stub 34, the support pole 30 or 30' may be longitudinally aligned and stacked over the base's top surface and the strap 75 may be wrapped around the base 12 and the support pole 30, 30' to hold them together.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An adjustable kneeling support pad, comprising:

a. a rectangular, elongated base with two end surfaces, a flat bottom surface, and a top surface made or covered with resilient material;

b. a fixed, rigid stub perpendicularly aligned and extending upward from the top surface on the base near one end surface;

c. a removable support pole configured to slide longitudinally and rotate axially 360 degrees around the stub, the support pole includes a distal end;

d. a grip handle attached to one end of the distal end of the support pole, the grip handle including a gripping member substantially perpendicular to the support pole; and, e. a clamp disposed between the stub and the proximal end of the support pole configured to selectively force overlapping areas on the stub and support pole together to hold them together to prevent rotation of the support pole over the rigid stub and to fix the gripping member at a desired height above the top surface.

2. The support pad, as recited in claim 1, wherein the support pole slides into the stub and the clamp is affixed to the stub.

3. The support pad, as recited in claim 1, further including a strap having a sufficient length that enables it to encircle the base and the support pole when removed from the stub and aligned longitudinally over the base.

4. The support pad, as recited in claim 1, wherein the base is made of nitrile rubber.

5. The support pad, as recited in claim 1, wherein the top surface is made of nitrile rubber.

6. A kneeling support pad, comprising:

a. an elongated rectangular base with a top surface, a flat bottom surface, and an end surface;

b. a permanently affixed stub perpendicularly aligned with and extending upward from the top surface of the base near an end surface;

c. a support pole configured to slide longitudinally and rotate axially 360 degrees around the stub, the support pole includes a distal end;

d. a rigid grip handle attached to the distal end of the support pole; and, e. an adjustable clamp disposed around the stub and the support pole configured to tighten the stub around the support pole thereby affixing the grip handle at a desired length and preventing the rotation of the support pole over the stub.

7. The support pad, as recited in claim 6, wherein the base in is made of plastic with an upper layer made of nitrile rubber.

8. The support pad, as recited in claim 6, wherein the base is made of nitrile rubber.

9. The support pad, as recited in claim 6, further including a strap having a sufficient length that enables it to encircle the base and the support pole when removed from the stub and aligned longitudinally over the base.

* * * * *